US012290188B2

(12) United States Patent
Wirth

(10) Patent No.: US 12,290,188 B2
(45) Date of Patent: May 6, 2025

(54) REFRIGERATED DISPLAY CASE

(71) Applicant: Wirth Research Limited, Oxfordshire (GB)

(72) Inventor: Nicholas J. P. Wirth, Kent (GB)

(73) Assignee: Wirth Research Limited, Bicester (GB)

( * ) Notice: Subject to any disclaimer, the term of this patent is extended or adjusted under 35 U.S.C. 154(b) by 106 days.

(21) Appl. No.: 17/759,998

(22) PCT Filed: Jan. 29, 2021

(86) PCT No.: PCT/EP2021/052184
§ 371 (c)(1),
(2) Date: Aug. 2, 2022

(87) PCT Pub. No.: WO2021/156156
PCT Pub. Date: Aug. 12, 2021

(65) Prior Publication Data

US 2023/0066886 A1 Mar. 2, 2023

(30) Foreign Application Priority Data

Feb. 3, 2020 (GB) ..... 2001463

(51) Int. Cl.
*A47F 3/04* (2006.01)
*F25D 23/02* (2006.01)

(52) U.S. Cl.
CPC ..... *A47F 3/0447* (2013.01); *A47F 3/0404* (2013.01); *A47F 3/0408* (2013.01); *A47F 3/043* (2013.01); *F25D 23/023* (2013.01)

(58) Field of Classification Search
CPC .... A47F 3/0447; A47F 3/0404; A47F 3/0408; A47F 3/043; F25D 23/023; F25D 2317/0672; F25D 23/00
See application file for complete search history.

(56) References Cited

U.S. PATENT DOCUMENTS 4,361,012 A 11/1982 Ibrahim
4,648,247 A 3/1987 Takizawa et al.
(Continued)

FOREIGN PATENT DOCUMENTS

GB 897121 A 5/1962
GB 2563474 A 12/2018
(Continued)

OTHER PUBLICATIONS

UK Combined Search and Examination Report, Application No. GB2001463.5, mailed Feb. 17, 2020.
(Continued)

*Primary Examiner* — Joseph F Trpisovsky
(74) *Attorney, Agent, or Firm* — Honigman LLP

(57) ABSTRACT

A refrigerated display case comprising: a refrigerated display area; a door configured to close an opening to the refrigerated display area; an air outlet spaced apart from an air inlet; a duct fluidically coupling the air inlet to the air outlet and configured to direct air flow out of the air outlet across the display area and toward the air inlet forming an air curtain across the display area; and an airflow inhibiting apparatus comprising: a conduit having an inlet and a plurality of outlet apertures arranged around a perimeter of the opening; a fan configured to draw air into the conduit via the inlet and to discharge a jet of air from each of the plurality of outlet apertures, the plurality of outlet apertures angled to repel ambient air away from the display area when the door is opened preventing airflow into the display area.

17 Claims, 8 Drawing Sheets

(56) References Cited

U.S. PATENT DOCUMENTS

| | | | | |
|---|---|---|---|---|
| 6,094,931 | A * | 8/2000 | Jeong | F25D 17/065 454/193 |
| 6,722,149 | B1 * | 4/2004 | Saroka | A47F 3/0447 454/193 |
| 2004/0003617 | A1 | 1/2004 | Chandler et al. | |
| 2005/0138943 | A1 * | 6/2005 | Alahyari | A47F 3/0447 62/256 |
| 2016/0278542 | A1 | 9/2016 | Eget et al. | |
| 2018/0103777 | A1 * | 4/2018 | Bates | F25D 17/06 |
| 2019/0142185 | A1 | 5/2019 | Bates et al. | |
| 2020/0352358 | A1 * | 11/2020 | Joardar | A47F 3/0408 |

FOREIGN PATENT DOCUMENTS

| | | | |
|---|---|---|---|
| WO | 2006039043 | A1 | 4/2006 |
| WO | 2019174729 | A1 | 9/2019 |

OTHER PUBLICATIONS

International Search Report and Written Opinion, Application No. PCT/EP2021/052184, mailed Apr. 12, 2021. ISA/European Patent Office.

Written Opinion of the International Preliminary Examining Authority, Application No. PCT/EP2021/052184, mailed Jan. 11, 2022. IPEA/European Patent Office.

International Preliminary Report on Patentability, Application No. PCT/EP2021/052184, dated Apr. 29, 2022. IPEA/European Patent Office.

* cited by examiner

REFRIGERATED DISPLAY CASE

CROSS-REFERENCE TO RELATED APPLICATIONS

This application is the U.S. national stage of PCT/EP2021/052184 filed on Jan. 29, 2021, which claims priority of UK Patent Application No. GB 2001463.5 filed on Feb. 3, 2020, the contents of which are incorporated herein.

TECHNICAL FIELD

The disclosure relates to a refrigerated display case.

BACKGROUND

The display of chilled or frozen items is commonplace in many retail environments, most notably in supermarkets. Such items are often displayed in refrigerated display cases having hinged or sliding doors. Refrigerated display cases utilise an air curtain which is cooled to below ambient temperature and propelled downward, across the front of the display case and behind the door(s).

The energy consumed by such refrigerated display cases presents a significant contribution to the overall energy consumption of the supermarket. It is therefore desirable to improve the efficiency of refrigerated display cases.

SUMMARY

According to an aspect of the disclosure there is provided a refrigerated display case comprising: a refrigerated display area; an air outlet and an air inlet opening into the display area and spaced from one another; a duct fluidically coupling the air inlet to the air outlet, the duct being configured to direct air flow out of the air outlet across the display area and toward the air inlet to form an air curtain across the display area; and an airflow inhibiting apparatus comprising: a conduit having an inlet and a plurality of outlet apertures, the outlet apertures arranged around a perimeter of an upper portion of an opening to the refrigerated display area; a fan fluidically connected to the conduit and configured to draw air into the conduit via the inlet and to discharge a jet of air from each of the plurality of outlet apertures; wherein the outlet apertures are each arranged such that the jet of air is angled outwards away from the display area to repel ambient air away from the display area so as to prevent airflow into the display area.

The outlet apertures may be provided around the upper portion of the opening only.

The conduit may form a frame e.g. a door frame.

The frame may comprise a lower horizontal section, an upper horizontal section and a pair of vertical sections. The inlet may be formed in the lower horizontal section and the outlet apertures may be arranged across the upper horizontal section and along upper portions of the vertical sections.

The refrigerated display case may further comprise a door configured to selectively close the opening to the refrigerated display area. The airflow inhibiting apparatus and more specifically the outlet apertures may act to repel ambient air away from the display area when the door is opened so as to prevent airflow into the display area.

The refrigerated display case may comprise a plurality of doors each configured to selectively close a respective opening to the refrigerated display area, wherein each opening is provided with an inlet and a plurality of outlet apertures.

The inlet and the plurality of outlet apertures of each opening may be connected to a common conduit.

The inlet of the conduit may be provided at a lower portion of the opening and may be configured to receive air which spills out from the air curtain when the door is opened.

The airflow inhibiting apparatus may be configured to generate the jets of air from the outlet apertures only when the door is opened.

The airflow inhibiting apparatus may comprise a valve which is configured to close the outlet apertures when the door is closed and/or a valve which is configured to close the inlet of the conduit when the door is closed.

The valve may comprise one or more seal members which are provided on the door and which cover the outlet apertures and/or inlet when the door is closed.

The fan may be configured to be activated continuously whether the door is open or closed.

The airflow inhibiting apparatus may comprise a sensor which is configured to detect when the door is opened and provides a control signal to activate the fan when the door is open.

A guide portion may be provided adjacent each of the outlet apertures to direct the jet of air in a predefined direction.

The guide portion may be disposed within the conduit.

The outlet apertures may be each arranged such that the jet of air is angled outwards at an angle of 20 to 40 degrees.

The outlet apertures may be each arranged such that the jet of air is angled outwards at an angle of 30 degrees.

The refrigerated display case may be a freezer display case.

BRIEF DESCRIPTION OF DRAWINGS

For a better understanding of the disclosure, and to show more clearly how it may be carried into effect, reference will now be made, by way of example, to the accompanying drawings, in which:—

DETAILED DESCRIPTION OF PREFERRED EMBODIMENTS

Figure 1:
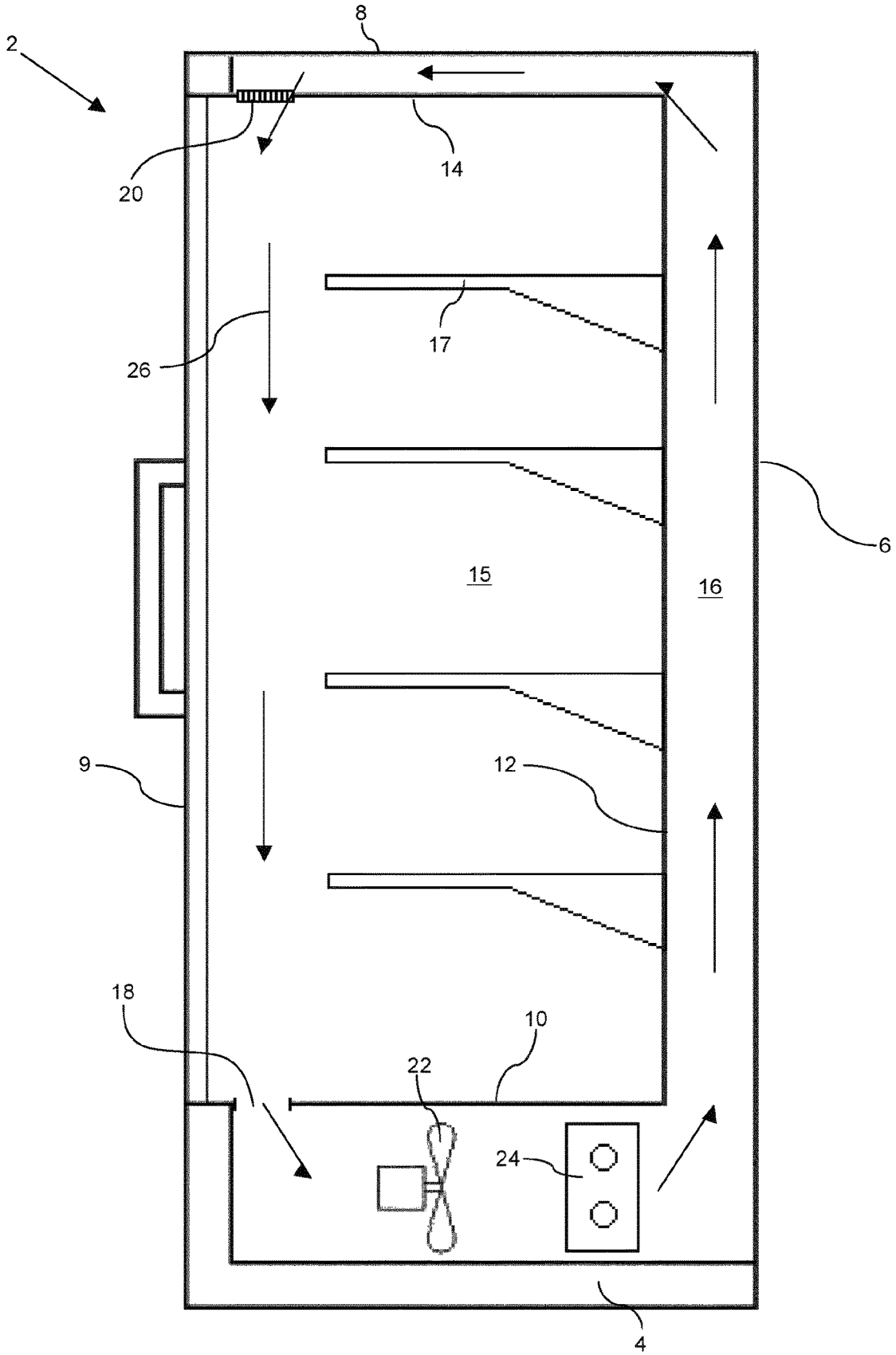
FIG. 1 Prior Art
FIG. 1 is a side cross-sectional view of a conventional refrigerated display case.

FIG. 1 shows a conventional refrigerated display case 2. The refrigerated display case 2 comprises a cabinet portion formed by a lower wall 4, a back wall 6, an upper wall 8, and left and right side walls (not shown). One or more doors 9 are provided at the front of the cabinet portion. The doors may be slidably or hingedly connected to the cabinet portion via the lower and upper walls 4, 8 or via the side walls. A lower panel 10, a back panel 12 and an upper panel 14 are disposed within the cabinet portion.

The lower, back and upper panels 10, 12, 14 and the doors 9 form a display area 15 which is provided with a plurality of shelves 17 (four are shown) on which items may be displayed. The shelves 17 are affixed to the back panel 12.

As shown, the lower, back and upper panels 10, 12, 14 are spaced from the respective lower, back and upper walls 4, 6, 8 to form a duct 16. An intake grille 18 is provided at the lower panel 10 to form an inlet to the duct 16. Similarly, a discharge grille 20 is provided at the upper panel 14 to form an outlet from the duct 16. The intake grille 18 and the discharge grille 20 are thus fluidically coupled to one another by the duct 16. The intake grille 18 and the discharge grille 20 are spaced from the back panel 12 toward the front of the cabinet portion and ahead of the shelves 17.

A fan 22 and a heat exchanger 24 are located within the duct 16 adjacent to the intake grille 18 and thus are disposed between the lower wall 4 and the lower panel 10. The fan 22 draws air into the duct 16 via the intake grille 18 which then passes through the heat exchanger 24 where it is cooled to well below the ambient temperature.

After passing through the heat exchanger 24, the air continues through the duct 16 between the back wall 6 and the back panel 12. The back panel 12 is perforated allowing air to pass from the duct 16 into the display area 15 where it cools items located on the shelves 17 and on the lower panel 10.

The remaining air flows through the duct 16 to the discharge grille 20. The air is ejected from the discharge grille 20 and descends behind the doors 9 over the front of the display area 15 to form an air curtain 26. The air curtain 26 passes from the discharge grille 20 to the intake grille 18, where it is drawn in by the fan 22 and re-circulated through the duct 16.

In this example, the discharge grille 20 is provided with a honeycomb panel which rectifies the air flow as it exits the discharge grille 20 to provide flow with reduced turbulence.

It has been identified that when one of the doors 9 is opened, either by sliding or pivoting, warm ambient air is drawn into the display case 2 towards the top of the open doored region and cold air from within the display case spills out towards the bottom of the open doored region. Such air flows become more pronounced as the temperature within the display case is reduced since the buoyancy effects become stronger. Accordingly, this phenomenon is seen more readily in refrigerated display cases operating at freezing temperatures (i.e. freezer display cases).

Figure 2:
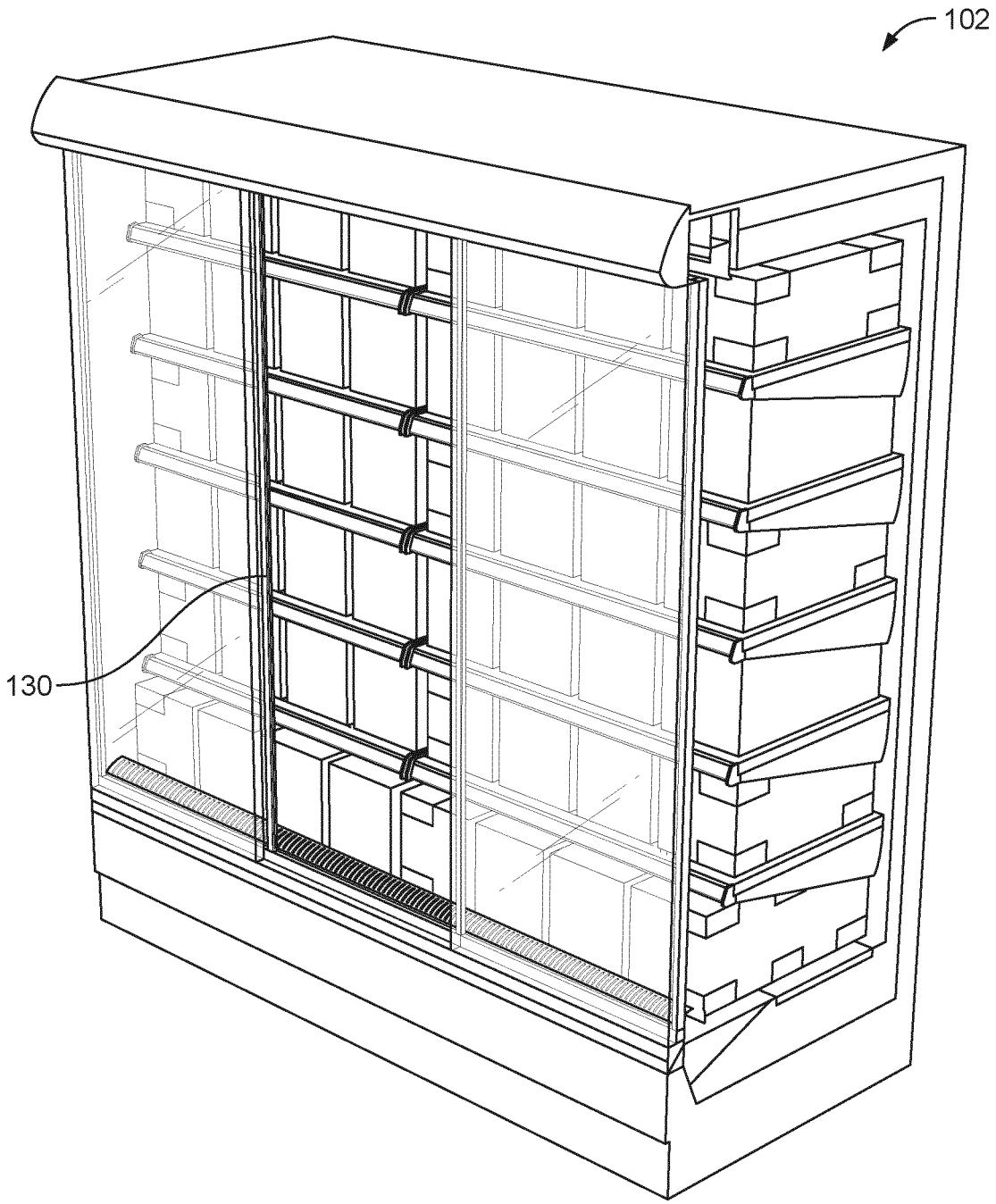
FIG. 2 is a perspective view of a refrigerated display case according to an embodiment of the disclosure.

FIG. 2 shows a refrigerated display case 102 according to an embodiment of the disclosure. The structure of the refrigerated display case 102 is generally as described previously with respect to the display case 2; however, the display case 102 is provided with an airflow inhibiting apparatus 130 which will be described in detail below.

Figure 3:
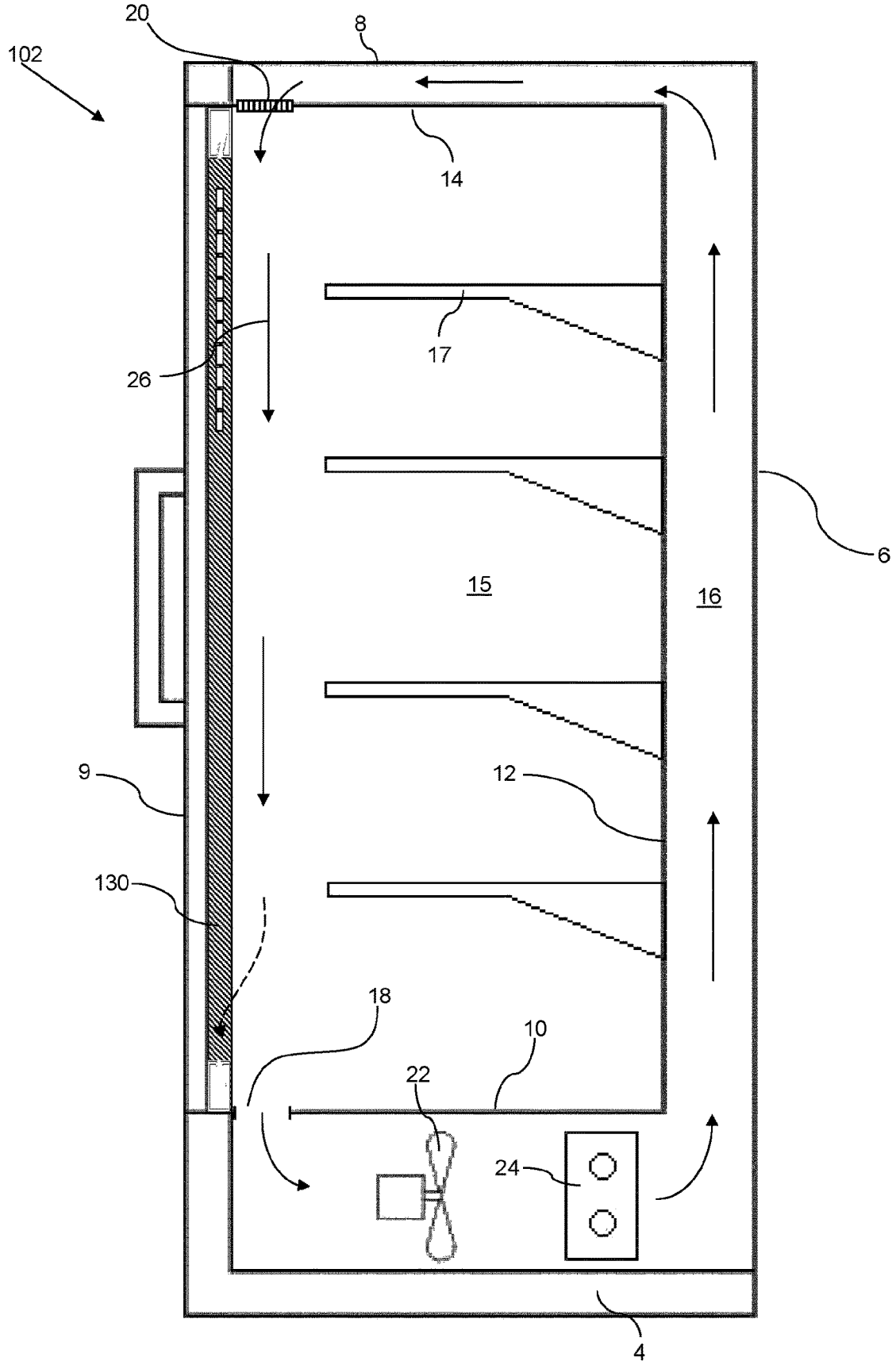
FIG. 3 is a side cross-sectional view of the refrigerated display case of FIG. 2.
Figure 4:
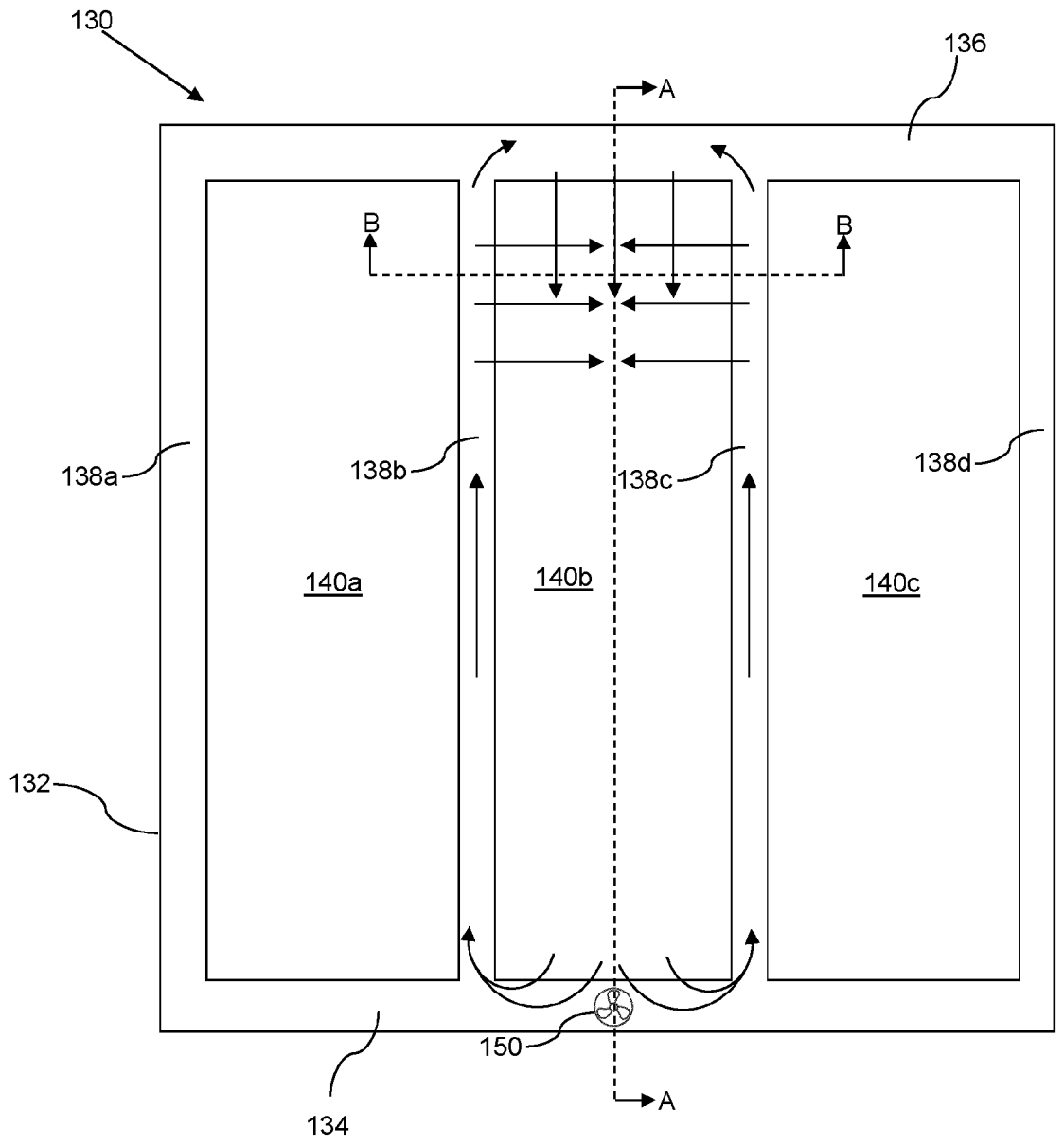
FIG. 4 is a front view of a door frame of the refrigerated display case of FIG. 2.

As shown in FIG. 3, the airflow inhibiting apparatus 130 is located internally within the refrigerated display case 102 inside of the doors 9. As shown in FIG. 4, the airflow inhibiting apparatus 130 comprises a structure which forms a frame 132 for the doors 9. The frame 132 comprises a lower horizontal section 134 and an upper horizontal section 136, and first, second, third and fourth vertical sections 138*a*-138*d* which extend between the lower and upper horizontal sections 134, 136. In combination with the upper and lower horizontal sections 134, 136, the first and second vertical sections 138*a*, 138*b* form a first opening 140*a*, the second and third vertical sections 138*b*, 138*c* form a second opening 140*b*, and the third and fourth vertical sections 138*c*, 138*d* form a third opening 140*c*. The refrigerated display case 102 comprises three doors 9 which seal against the frame 132 to selectively close the openings 140*a*-140*c*.

The horizontal and vertical sections of the frame 132 are hollow and are connected to one another to form a continuous conduit.

Figure 5:
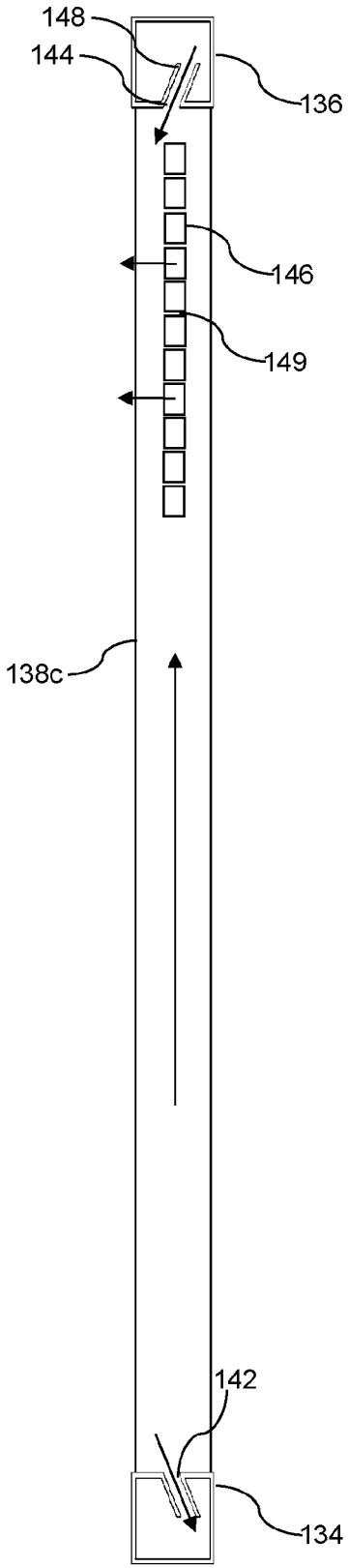
FIG. 5 is a vertical cross-sectional view along plane A-A in FIG. 4.
Figure 6:
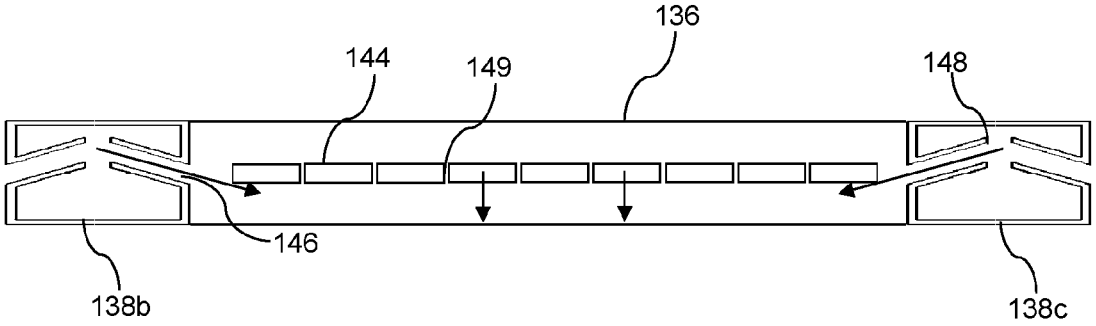
FIG. 6 is a horizontal cross-sectional view along plane B-B in FIG. 4.

As best shown in FIGS. 5 and 6, the lower horizontal section 134 is provided with a plurality of inlet slots 142 and the upper horizontal section 136 is provided with a plurality of outlet slots 144. The inlet slots 142 are spaced substantially along the length of the lower horizontal section 134 between adjacent vertical sections 138*a*-138*d* (i.e. across the width of the openings 140*a*-140*c*). Similarly, the outlet slots 144 are spaced substantially along the length of the upper horizontal section 136 between adjacent vertical sections 138*a*-138*d* (i.e. across the width of the openings 140*a*-140*c*).

The vertical sections 138*a*-138*d* are also provided with outlet slots 146. The outlet slots 146 are only provided over an upper portion of the vertical sections 138*a*-138*d* and a lower portion of the vertical sections 138*a*-138*d* is devoid of any outlet slots 146. For example, the outlet slots 146 may only cover the upper third of the vertical sections 138*a*-138*d* and the bottom two-thirds may not be provided with any outlet slots 146.

Portions of the vertical sections 138*a*-138*d* and the upper horizontal section 136 adjacent the corners between the vertical sections 138*a*-138*d* and the upper horizontal section 136 may not include any outlet slots 144, 146.

The first and fourth vertical sections 138*a*, 138*d* are provided with outlet slots 146 along an inner surface, whereas the second and third vertical sections 138*b*, 138*c* are provided with outlet slots along two opposing surfaces, as shown in FIG. 6. Accordingly, outlet slots 146 are provided on opposing surfaces of adjacent vertical sections 138*a*-138*d* across the openings 140*a*-140*c*.

The outlet slots 144, 146 are angled outwards away from the display area 15. In particular, a guide portion 148 formed by a pair of a parallel plates is provided adjacent each outlet slot 144, 146. As shown, the guide portions 148 are located internally within the frame 132 (i.e. within the rectangular cross-section of the frame 132). In other examples, the guide portions 148 may extend out of the frame 132. The guide portions 148 may be angled outwards at an angle of 20 to 40 degrees, and more particularly 30 degrees, from the plane of the opening 140*a*-140*c* (i.e. from the vertical or horizontal). As shown in FIG. 5 for the outlet slots 146 and in FIG. 6 for the outlet slots 144, a plurality of guide vanes 149 are located in the guide portions 148, adjacent the respective outlet slot 144, 146. The guide vanes 149 separate adjacent outlet slots 144, 146. The guide vanes 149 extend into the guide portion 148 from the respective outlet slot 144, 146. The guide portions 148 and guide vanes 149 cause the air within the vertical sections 138*a*-138*d* and the upper horizontal section 136 to be redirected so that air from the outlet slots 144 is directed vertically and air from the outlet slots 146 is directed horizontally. A guide portion may also be provided for each of the inlet slots 142 such that they are also angled outwards away from the display area 15. The guide portions 148 and guide vanes 149 may instead be formed by a honeycomb rectifier or a rectangular duct.

As shown in FIG. 4, the airflow inhibiting apparatus 130 comprises a fan 150 disposed within the conduit formed by the frame 132. Although only a single fan 150 is shown, it will be appreciated that a plurality of fans may be provided. For example, a fan 150 may be provided in each of the vertical sections 138*a*-138*d* or a separate fan 150 may be provided beneath each of the openings 140*a*-140*c*. The or each fan 150 acts to draw air into the inlet slots 142 and to drive this towards the outlet slots 144, 146, as will be described further below.

FIGS. 7 and 8 depict the sealing of the door 9 against the second and third vertical sections 138*b*, 138*c* over the opening 140*b* (with the same arrangement being used for the other doors 9). In this example, the door 9 is hinged adjacent the third vertical section 138*c*.

Figure 7A:
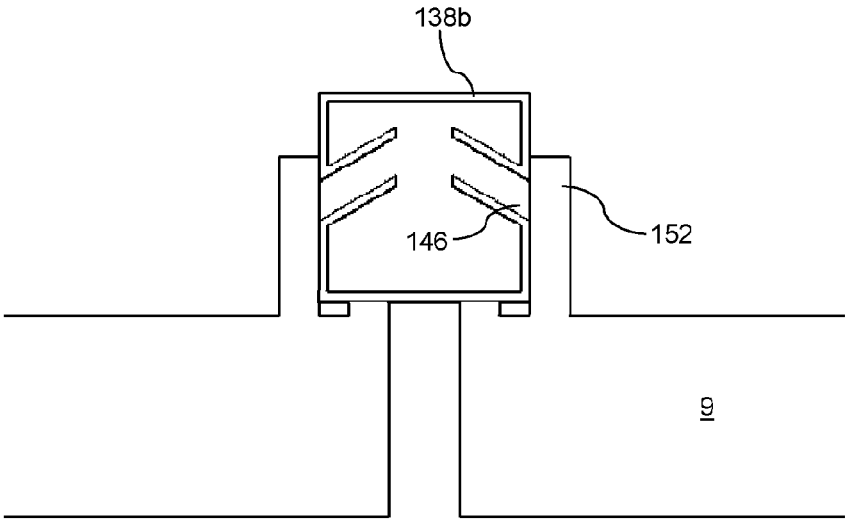
FIGS. 7A and 7B show a non-hinge side of a door of the refrigerated display case in a first position and a second position.
Figure 7B:
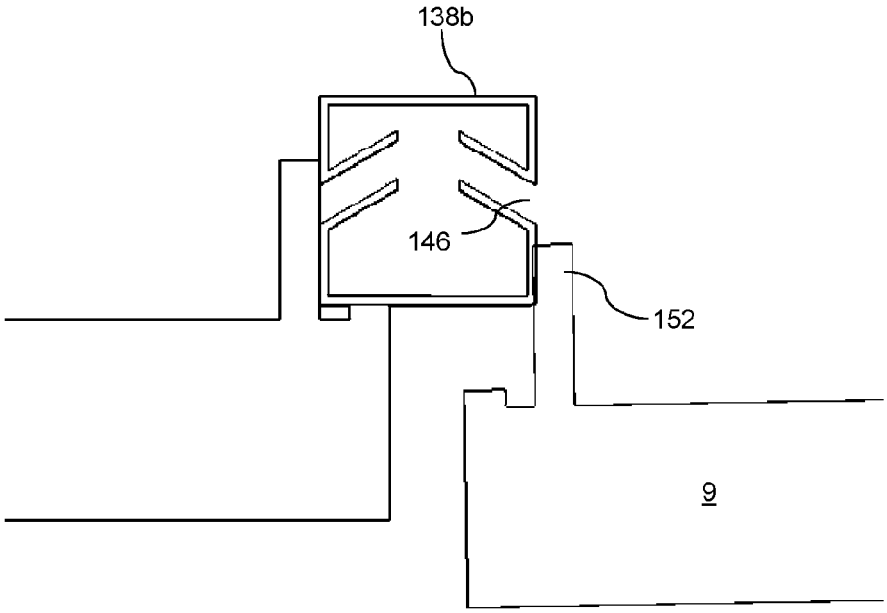

As shown, the door 9 comprises a seal member 152 which runs vertically along an edge of the door. The seal member 152 forms a lip which projects inwardly from the door 9 (e.g. from a frame of the door 9). As shown in FIG. 7A, the seal member 152 seals against the outlet slots 146 of the second vertical section 138*b* when the door 9 is closed. FIG. 7B shows the door 9 as it is opened by an angle of 1 degree. As shown, in this position the seal member 152 moves across the second vertical section 138*b* away from the outlet slots 146. The seal member 152 thus no longer provides an obstruction over the outlet slots 146 when the door 9 is opened.

Figure 8A:
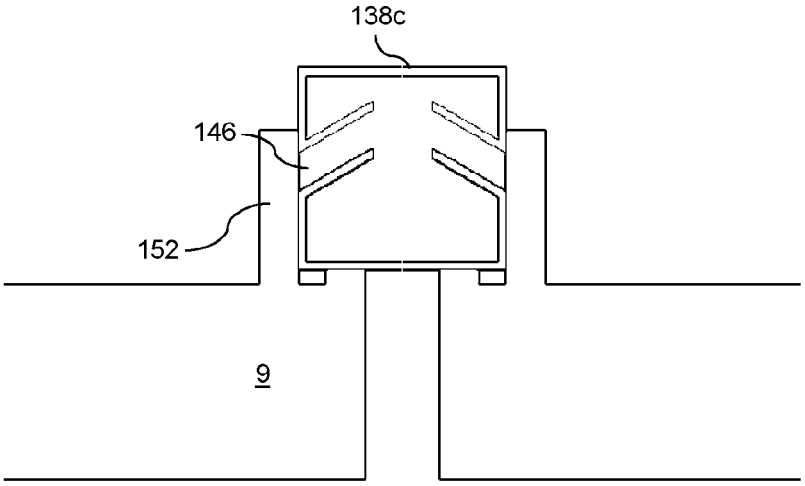
FIGS. 8A-8C show a hinge side of the door of the refrigerated display case in first, second and third positions.
Figure 8B:
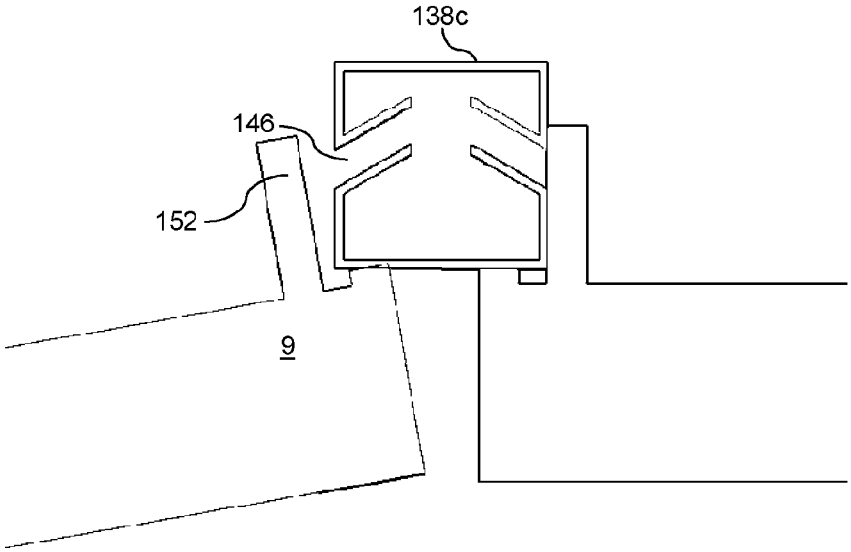
Figure 8C:
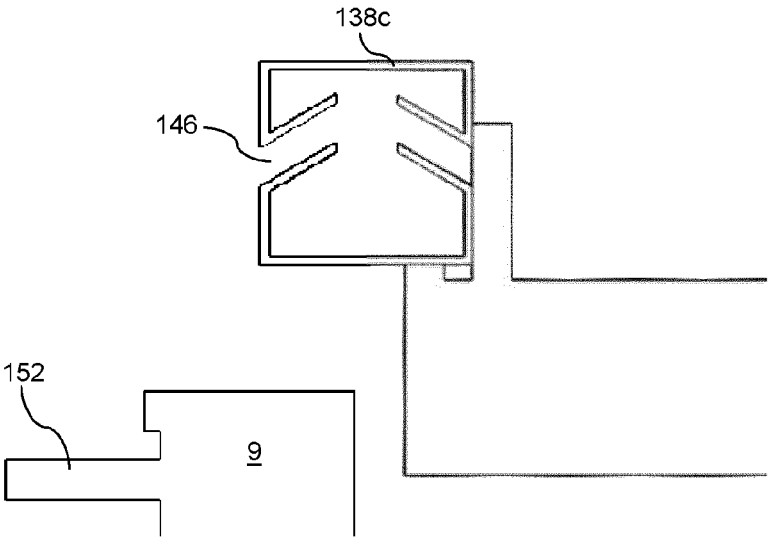

As shown in FIG. 8A, the opposing (hinge) side of the door 9 is also provided with a seal member 152 which seals against the outlet slots 146 of the third vertical section 138*c* when the door 9 is closed. FIGS. 8B and 8C shows the door 9 as it is opened by an angle of 5 and 90 degrees respectively. As shown, as the door 9 is opened, the seal member 152 moves across the third vertical section 138*c* away from the outlet slots 146. The seal member 152 thus no longer provides an obstruction over the outlet slots 146 when the door 9 is opened.

Although not shown, similar seal members 152 are also provided along horizontal edges of the door 9 to seal against the lower and upper horizontal sections 134, 136 of the frame 132 and thus selectively close the inlet and outlet slots 142, 144. In some examples, a single seal member 152 may extend around the entire perimeter of the door 9.

The or each seal member 152 effectively forms a valve which selectively closes the slots in the frame 132 when the door 9 is closed. It will be appreciated that other forms of valves may be used to close the inlet and/or outlet slots (whether directly or indirectly via an obstruction positioned along the length of the conduit).

FIG. 4 shows the airflow within the frame 132 when the door 9 over the second opening 140*b* is opened. As described previously, when the door 9 is opened, the seal members 152 move away from the inlet and outlet slots 142, 144, 146 to allow air to pass therethrough. In contrast, the inlet and outlet slots 142, 144, 146 around the first and third openings 140*a*, 140*c* remain covered by the seal members 152 of their respective doors 9 and thus prevent air from passing therethrough.

When the door 9 is opened, cold air from the air curtain 26 deviates outwards from its normal trajectory (see the dashed arrow in FIG. 3). As shown in FIG. 4, the fan 150 acts to draw this air into the inlet slots 142 beneath the second opening 140*b* and to force the air upwards along the second and third vertical sections 138*b*, 138*c* (and also potentially via the other vertical sections) and to the upper horizontal section 136. The air is ejected from the outlet slots 144, 146 which surround the upper part of the second opening 140*b*. The outlet slots 146 of the second vertical section 138*b* and the outlet slots 146 of the third vertical section 138*c* are directed towards one another such that the air from the outlet slots 146 converges at the horizontal centre of the opening 140*b*, but spaced outwards away from the opening 140*b* (i.e. it intersects at a vertical plane which is perpendicular to the plane of the opening 140*b* and passes through the horizontal centre of the opening 140*b*). The air from the outlet slots 144 also converges with the air from the outlet slots 146. The air from the outlet slots 144, 146 has a relatively high velocity which may, for example, be greater than that of the air from the discharge grille 20 which forms the air curtain 26

The air from the outlet slots 144, 146 forms a barrier which acts to repel warm ambient air which would otherwise be drawn into the display case 102 towards the top of the opening 140*b*. The airflow inhibiting apparatus 130 is thus able to prevent warm air from infiltrating into the display case 102 and thus improves efficiency.

Although the operation of the airflow inhibiting apparatus 130 has been described above in relation to the opening of a single door, the same principles apply where multiple doors are opened simultaneously.

In some examples, the fan 150 may be activated only when one or more of the doors are opened. For example, a sensor may be used to identify when a door is opened and provide a control signal to operate the fan 150. The seal members 152 would block outlet slots 144, 146 for doors which are not opened such that air is directed only to those doors which are open.

In other examples, the fan 150 may operate continuously regardless of whether the doors are opened or closed. It has been found that this does not provide a significant increase in energy consumption. As the seal members 152 close the outlet slots 144, 146, the fan 150 may pressurise the frame 132 when the doors 9 are closed. This may be beneficial in that the conduit may be primed with air before the doors 9 are opened and thus can react more quickly to repel the ambient air.

In other examples, air may be blown from the outlet slots 144, 146 even when the doors are closed. Accordingly, it is not necessary for the fans to be triggered only when the doors are opened, nor to provide any seal members 152 or other valves.

In other examples, the inlet may be formed as a single slot in the lower horizontal section 134.

It will be appreciated that the refrigerated display case 102 may contain any number of doors and the frame 132 may be configured accordingly. Further, the frame 132 may be divided into discrete sections for each door which form separate conduits. In this case, each of the sections may comprise its own fan 150. In some examples, the fan 150 of each section may only be operated when its respective door is opened. The disclosure may also be applied to open refrigerated display cases which do not have doors. For example, the disclosure may be implemented in an open refrigerated display case which is configured to allow roll containers (i.e. cages), such as those used for milk and other dairy products, to be rolled directly into the refrigerated display case either through the front or the rear of the refrigerated display case. Where the roll container is introduced through the front of the refrigerated display case, the vertical sections may be spaced a greater distance from one another than the width of the roll container so that the roll container can pass therebetween. The lower horizontal section may also be of sufficiently low profile that the roll container can easily roll over it. The lower horizontal section may be partially or fully recessed in the floor to facilitate this.

In other examples, a conduit may be formed between the inlet slots and the outlet slots which does not form a door frame. For example, the conduit may be routed around the rear of the display case in a similar way to the duct 16.

Further, in other examples, the airflow inhibiting apparatus 130 may utilise ambient air, rather than air which has spilt out from the air curtain 26. Alternatively, the air may be refrigerated air which is taken from the duct 16 before it exits the discharge grille 20 and is accelerated further to provide a higher velocity at the outlet slots 144, 146.

Although the doors of the display case 102 have been described as being hinged, it will be appreciated that they may instead be formed as sliding doors. In this case, the seal members 152 may be adapted so that they perform the same function of obstructing the inlet and outlet slots 142, 144, 146 when the door is closed and clearing the inlet and outlet slots 142, 144, 146 when the door is opened.

It will be appreciated that the inlet and outlet slots need not be slot-shaped and other forms of aperture may be used.

The invention claimed is:

1. A refrigerated display case comprising:

a refrigerated display area;

an air outlet and an air inlet opening into the display area and spaced from one another;

a duct fluidically coupling the air inlet to the air outlet, the duct being configured to direct air flow out of the air outlet across the display area and toward the air inlet to form an air curtain across the display area; and an airflow inhibiting apparatus comprising:

a conduit having an inlet and a plurality of outlet apertures, the outlet apertures arranged around a perimeter of an upper portion of an opening to the refrigerated display area;

a fan fluidically connected to the conduit and configured to draw air into the conduit via the inlet and to discharge a jet of air from each of the plurality of outlet apertures;

wherein the outlet apertures are each angled outwards away from the display area such that the jet of air is angled outwards away from the display area to repel ambient air away from the display area so as to prevent airflow into the display area;

wherein the inlet of the conduit is provided at a lower portion of the opening to the refrigerated display area;

wherein the conduit forms a frame;

wherein the frame comprises a lower horizontal section, an upper horizontal section and a pair of vertical sections; wherein the inlet is formed in the lower horizontal section and the outlet apertures are arranged across the upper horizontal section and along upper portions of the vertical sections.

2. A refrigerated display case as claimed in claim 1, wherein the outlet apertures are provided around the upper portion of the opening only.

3. A refrigerated display case as claimed in claim 1, further comprising a door configured to selectively close the opening to the refrigerated display area.

4. A refrigerated display case as claimed in claim 1, wherein the refrigerated display case comprises a plurality of doors each configured to selectively close a respective opening to the refrigerated display area, wherein each opening to the refrigerated display area is provided with said inlet and said plurality of outlet apertures.

5. A refrigerated display case as claimed in claim 4, wherein the inlet and the plurality of outlet apertures of each opening to the refrigerated display area are connected to the conduit which forms a common conduit.

6. A refrigerated display case as claimed in claim 3, wherein the inlet of the conduit is configured to receive air which spills out from the air curtain when the door is opened.

7. A refrigerated display case as claimed in claim 3, wherein the airflow inhibiting apparatus is configured to generate the jets of air from the outlet apertures only when the door is opened.

8. A refrigerated display case as claimed in claim 7, wherein the airflow inhibiting apparatus comprises a valve which is configured to close the outlet apertures when the door is closed and/or a valve which is configured to close the inlet of the conduit when the door is closed.

9. A refrigerated display case as claimed in claim 8, wherein the valve comprises one or more seal members which are provided on the door and which cover the outlet apertures and/or inlet when the door is closed.

10. A refrigerated display case as claimed in claim 8, wherein the fan is configured to be activated continuously whether the door is open or closed.

11. A refrigerated display case as claimed in claim 7, wherein the airflow inhibiting apparatus comprises a sensor which is configured to detect when the door is opened and provides a control signal to activate the fan when the door is open.

12. A refrigerated display case as claimed in claim 1, wherein a guide portion is provided adjacent each of the outlet apertures to direct the jet of air in a predefined direction.

13. A refrigerated display case as claimed in claim 1, wherein the guide portion is disposed within the conduit.

14. A refrigerated display case as claimed in claim 1, wherein the outlet apertures are each arranged such that the jet of air is angled outwards at an angle of 20 to 40 degrees.

15. A refrigerated display case as claimed in claim 14, wherein the outlet apertures are each arranged such that the jet of air is angled outwards at an angle of 30 degrees.

16. A refrigerated display case as claimed in claim 1, wherein the refrigerated display case is a freezer display case.

17. A refrigerated display case comprising:

a refrigerated display area;

an air outlet and an air inlet opening into the display area and spaced from one another;

a duct fluidically coupling the air inlet to the air outlet, the duct being configured to direct air flow out of the air outlet across the display area and toward the air inlet to form an air curtain across the display area; and an airflow inhibiting apparatus comprising:

a conduit having an inlet and a plurality of outlet apertures, the outlet apertures arranged around a perimeter of an upper portion of an opening to the refrigerated display area;

a fan fluidically connected to the conduit and configured to draw air into the conduit via the inlet and to discharge a jet of air from each of the plurality of outlet apertures;

wherein the outlet apertures are each angled outwards away from the display area such that the jet of air is angled outwards away from the display area to repel ambient air away from the display area so as to prevent airflow into the display area;

wherein the inlet of the conduit is provided at a lower portion of the opening to the refrigerated display area;

wherein the refrigerated display case further comprises a door configured to selectively close the opening to the refrigerated display area;

wherein the airflow inhibiting apparatus is configured to generate the jets of air from the outlet apertures only when the door is opened;

wherein the airflow inhibiting apparatus comprises a valve which is configured to close the outlet apertures when the door is closed and/or a valve which is configured to close the inlet of the conduit when the door is closed.

* * * * *